United States Patent [19]

Watkins

[11] Patent Number: 4,792,138

[45] Date of Patent: Dec. 20, 1988

[54] JIGSAW PUZZLE GAME

[76] Inventor: Kirk W. Watkins, 185 E. Parkwood Rd., Decatur, Ga. 30030

[21] Appl. No.: 940,724

[22] Filed: Dec. 11, 1986

Related U.S. Application Data

[63] Continuation-in-part of Ser. No. 699,685, Feb. 8, 1985, Pat. No. 4,669,734.

[51] Int. Cl.[4] ..... A63F 9/10

[52] U.S. Cl. ..... 273/157 R; 273/148 R; 273/DIG. 26

[58] Field of Search ..... 273/148 R, 157 R, DIG. 26

[56] References Cited

U.S. PATENT DOCUMENTS

| | | | |
|---|---|---|---|
| 2,037,966 | 4/1936 | Dailey | 273/157 R |
| 2,073,551 | 3/1937 | Cransoff | 273/148 R |
| 3,558,136 | 1/1971 | McFarland | 273/157 RX |
| 3,672,681 | 6/1972 | Wolf | 273/157 R |
| 4,219,194 | 8/1980 | Powers | 273/157 R |

FOREIGN PATENT DOCUMENTS

| | | | |
|---|---|---|---|
| 83294 | 7/1983 | European Pat. Off. | 273/157 R |
| 2259632 | 8/1975 | France | 273/157 R |
| 553798 | 6/1943 | United Kingdom | 273/157 R |

OTHER PUBLICATIONS

Rules for Hizzoner TM Puzzle Game, copyright 1987.
Letter from Michael Yeager dated Mar. 2, 1987.
"Situation 4" Game Rules, Parker Brothers, copyright 1968, Parker Brothers, Inc., Salem, Mass.
Playthings, Mar. 1969, p. 87.

*Primary Examiner*—Anton O. Oechsle
*Attorney, Agent, or Firm*—Jones, Askew & Lundsford

[57] ABSTRACT

A novel jigsaw puzzle game and method of playing the game are described. Points are assigned when players complete particular portions of the puzzle or play uniquely shaped pieces of the puzzle in a particular manner. Score cards are assigned to players when points are earned, and are totaled at the end of the game.

19 Claims, 5 Drawing Sheets

10
14
16
25
28
27
34
35
36
29
31
SCORE CARDS
12

JIGSAW PUZZLE GAME

CROSS-REFERENCE TO RELATED APPLICATION

This is a continuation-in-part application of application Ser. No. 699,685, now U.S. Pat. No. 4,669,734.

TECHNICAL FIELD

The present invention relates to a jigsaw puzzle game, and more particularly relates to a game in which pieces of a jigsaw puzzle are assembled by a player in ways which create scoring opportunities.

BACKGROUND ART

The assembly of jigsaw puzzles comprising many interlocking pieces to complete a design or picture on the face of the pieces is a pastime that has long been enjoyed by many people. However, no prior device is known which provides for the assembly of a jigsaw puzzle in connection with a game so that the speed with which the puzzle is assembled and the strategy of how the puzzle is assembled cause various point values to be assigned to players.

SUMMARY OF THE INVENTION

Generally described, the present invention is a game to be played by a number of players comprising a jigsaw puzzle for each player, each jigsaw puzzle having a number of interlocking pieces, and a scoring system associated with each puzzle. A first score is assigned to the player who first completes predetermined portions of any one puzzle, and a less favorable score is assigned to the player subsequently completing the same portion of another puzzle. The scoring system identifies the potential scores remaining for the completion of predetermined puzzle portions so that the extent to which a given player has completed his associated puzzle and the potential scores remaining for the completion of predetermined puzzle portions affect the play of others seeking to maximize their score.

The scoring system can also include a game board for each player. The game board has indicia thereon defining an outline and a plurality of corresponding zones within the outlet. At least some of the zones either individually or collectively define the predetermined portions, and each puzzle, when assembled, fits on a game board and covers the indicia.

The puzzles can have differing degrees of difficulty determined by the difficulty in assembling the pieces of the puzzle. The degree of difficulty is at least partially determined by the number of interlocking pieces making up each puzzle. The different degrees of difficulty are provided to allow appropriate puzzle selection for players of differing ability so that players of substantially different abilities can play the game competitively.

DETAILED DESCRIPTION OF THE PREFERRED EMBODIMENT

Figures 1, 2:
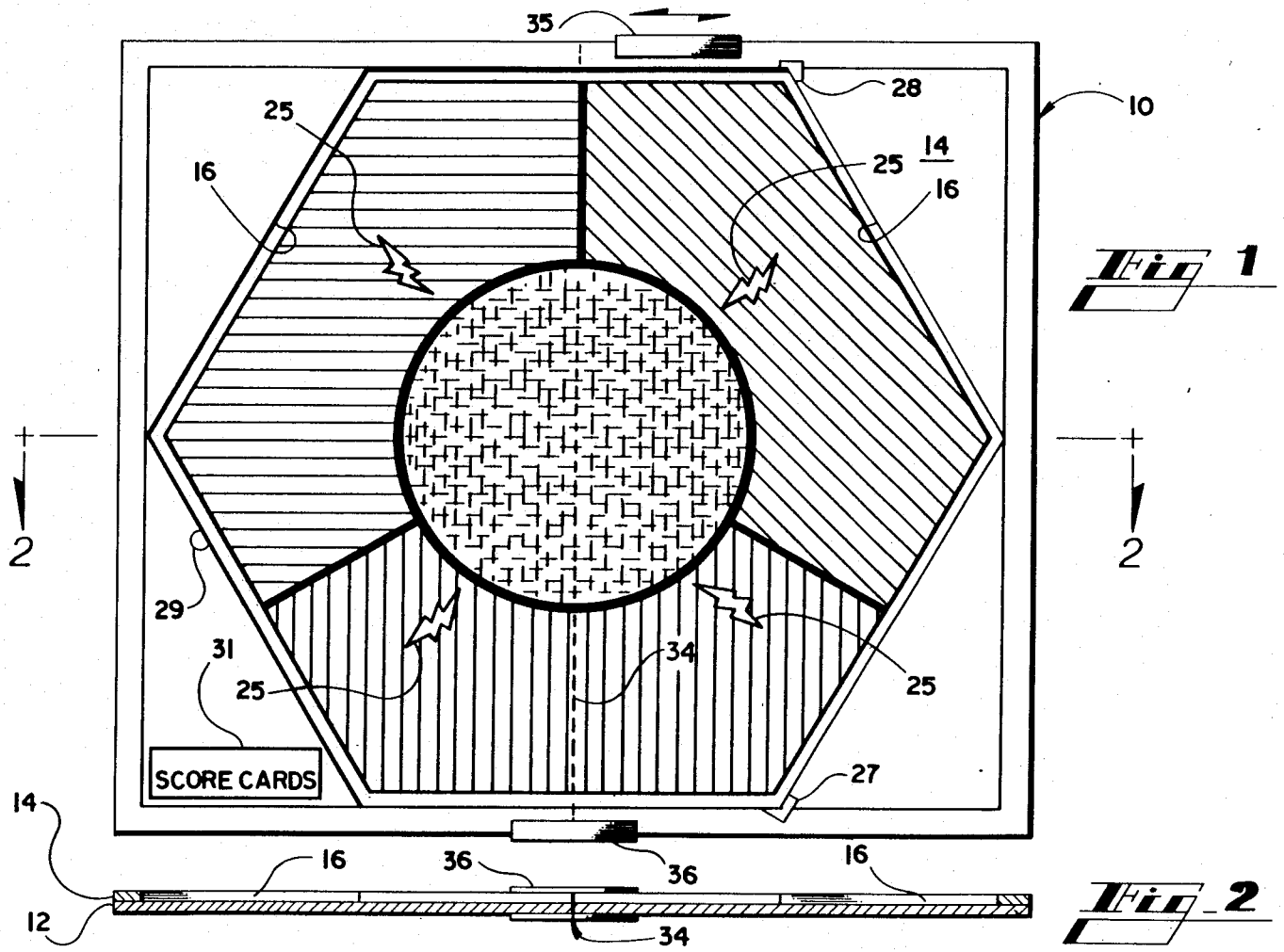
FIG. 1 shows a top plan view of a game board of the first preferred embodiment of the present invention.
FIG. 2 shows a vertical cross-sectional view of the game board taken along line 2—2 of FIG. 1.
Figures 3, 4, 5, 6:
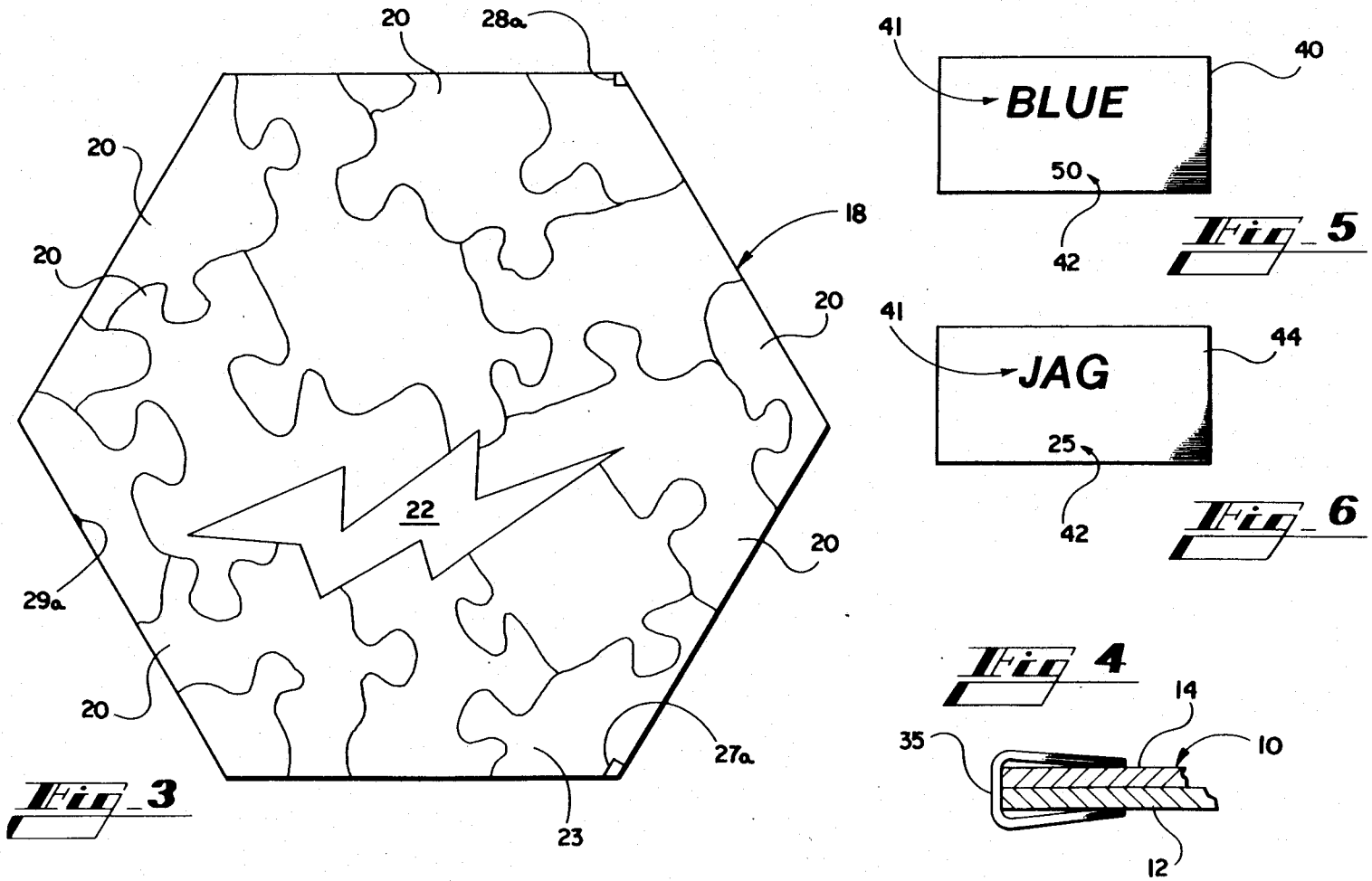
FIG. 3 shows a top plan view of a jigsaw puzzle that can be assembled on the game board shown in FIG. 1.
FIG. 4 shows a partial cross-sectional view of a locking clip used in connection with the game board of FIG. 1.
FIG. 5 is a plan view of a scoring card according to the invention.
FIG. 6 is a plan view of another scoring card according to the invention.

Referring now in more detail to the drawings, in which like numerals refer to like parts throughout the several views, FIG. 1 shows a top plan view of a game board 10 of a first preferred embodiment of the present invention. The game board is preferably constructed of a bottom layer 12 and a top or border layer 14, as shown best in FIG. 2. The top layer has defined therein a central opening 16, preferably in the shape of a hexagon. Within the recess created by the opening 16, the upper surface of the bottom layer 12 has indicia printed thereon defining distinctive zones within the opening 16. As shown, the zones are differentiated by their color and are shown as a yellow central zone surrounded by a blue zone, a green zone and a red zone. When the top layer 14 is produced, the material removed to form the central opening 16 preferably forms a jigsaw puzzle 18 as shown in FIG. 3. When assembled, the puzzle 18 fits matingly within the opening 16 of the game board 10. The puzzle 18 comprises a plurality of conventional interlocking pieces 20, as well as a piece 22 having a distinctly different shape from the remainder of the interlocking pieces 20. The game board includes indicia 25 within the colored zones. Such indicia have a different color, such as white, from the colors of the zones, and preferably have a similar shape to the distinctly different puzzle piece 22.

In order to assure that the puzzle is correctly oriented with respect to the game board, key indicia are provided associated with each peripheral zone of the game board. When the border layer 14 and game board are printed, prior to die cutting the puzzle from the center of the border layer 14, the key indicia are printed within each zone overlapping a puzzle piece and the adjoining border area. For example, a hexagonal key indicia 27 has a first portion printed on the game board, and the remaining portion of the hexagon printed on puzzle piece 23. Similarly, key indicia 28 is in the form of a square, with one portion of the square printed on the game board, and the remaining portion **28*a* of the square printed on a puzzle piece. Similarly, in another zone, the portion of a circle 29 printed on the game board is completed by the remaining portion of the circle 29*a* on a puzzle piece. It will be seen that when the puzzle is assembled with the pieces bearing the key indicia portions 27*a*, 28*a* and 29*a* placed in mating relationship with the corresponding portions of key indicia 27, 28 and 29**, the puzzle will be oriented in a particular relationship to the game board.

It will be understood by those skilled in the art that each of the key indicia 27, 28 and 29 could have the same geometric shape, such as a triangle, with each indicia being imprinted in a different color so that the puzzle will be oriented in the particular relationship to the game board described above.

An indicia 31 is placed on the game board 10 to provide a location for score cards won by a player. A pair of score cards is shown in FIGS. 5 and 6. FIG. 5 shows a score card 40 which includes an indicia 41 indicating which portion of the game board has been covered or reached by pieces of the jigsaw puzzle 18. Another indicia 42 is included on the card 40 to show points won. FIG. 6 shows a score card 44 having similar indicia 41 and indicia 42. Score card 40 would be drawn when the blue zone has been covered by pieces 20 of the puzzle. Score card 44 would be drawn when one of the indicia 25 of the game board has been connected by puzzle pieces to the outline of the central opening 16 of the game board. Many other scoring possibilities are provided, as described below.

The game board is provided with a central score 34 (shown in dotted lines in FIG. 1). The board can be folded about the score 34 for packaging and storage. In order to prevent the board from folding when puzzle pieces are present on the board, a pair of flexible plastic clips 35 and 36 are provided in sliding relationship along the edges of the board. The clip 35 in FIG. 1 is shown moved away from the score 34, so that the board can be folded when both clips are in this position. A clip 36 is shown in locking position, wherein the board is prevented from folding. The clips 35 and 36 can be constructed in the manner in which "backbone" clips are formed for removably binding loose leaf sheets together, often within transparent plastic covers.

The first preferred embodiment of the game of the present invention can be played competitively by persons of all ages. The primary objective of the game is to assemble the puzzle pieces faster than an opponent assembles his own puzzle. Thus, when played competitively, each player or team has a separate game board and puzzle. During assembly of the puzzle pieces, particular coverage of the game board gives rise to various scoring events. Upon scoring, the player draws the appropriate score card to be saved and totaled when the game is completed.

Each player's objective is to obtain the highest number of points before the game ends, which occurs when the first player completes his or her puzzle. Points are scored as each player (or team) assembles their separate jigsaw puzzle on their separate board. To win score cards, portions of the board must be covered with puzzle pieces. The following occurrences entitle a player to a particular score card:

(1) One type of score card is awarded when a portion of the outline of the central opening 16 is completed. This can occur, for example, when one of the six hexagonal sides has connected puzzle pieces lying completely along it.

(2) The complete covering of a color zone on the board entitles a player to another appropriate score card.

(3) Another type of score card is obtained when a player continuously connects puzzle pieces from the key indicia 27, 28 or 29 of the outline of the opening 16 to touch one of the special indicia 25 on the board.

(4) Another type of score card is won by continuously connecting puzzle pieces including the distinctly difference piece 22 to the key indicia 27, 28 or 29 of the outline of the playing opening.

(5) Another score card is obtained when the entire puzzle is completed.

As indicated above, each score card signifies how many points it is worth. The score cards are arranged so that the first player to complete one of the categories receives the highest possible point total for that category. The next player to receive a score card for that category receives a lower point total. In this way, speed of assembly of the puzzle is rewarded, and the players can exercise strategy decisions to determine which categories to pursue first on account of the speed with which they think the category can be accomplished and the number of points it is worth. Players can examine the score cards to readily ascertain the potential scores remaining and can then decide which portion of the puzzle to complete at that time. For example, if the score card having the highest value for one particular portion of the puzzle has already been assigned to a first player, a second player may wish to concentrate his efforts on the completion of a different portion of the puzzle for which a score card having an equal or greater value has not already been assigned.

The skill level required to play the game according to the invention can be varied greatly by providing many different puzzles that will fit within the opening in the game board. One skill factor is the number of pieces in the puzzle. Another skill factor is the nature of the graphic design on the puzzle, since, for example, detailed patterns may be easy to match, but solid color areas are harder. By providing a range of skill levels, adults can compete directly with children while still exerting their best efforts on a harder puzzle.

The hexagonal shape of the puzzle lends itself readily to puzzle variations, because a new puzzle can be created by rotating the die through increments of 60 degrees about the center of the puzzle.

The method of playing the game can be modified in many ways. A progressive version of the game requires players to play a series of games with the number of puzzle pieces in the puzzle increasing with each game until a set number of points is accumulated. Speed can be emphasized by using games with smaller numbers of pieces. A single player can play the game by assembling as much of a puzzle as possible while accumulating points during a set period of time. For example, the player can accumulate cards for the first ten minutes and place them in one stack, accumulate cards for the next ten minutes in another stack, and so on. The point totals gained in the early going can then be weighted more heavily than the points earned later on. Bonus points can be awarded if the entire puzzle is complete in less than a fixed amount of time. The player can try to improve his score in later attempts.

Figure 7:
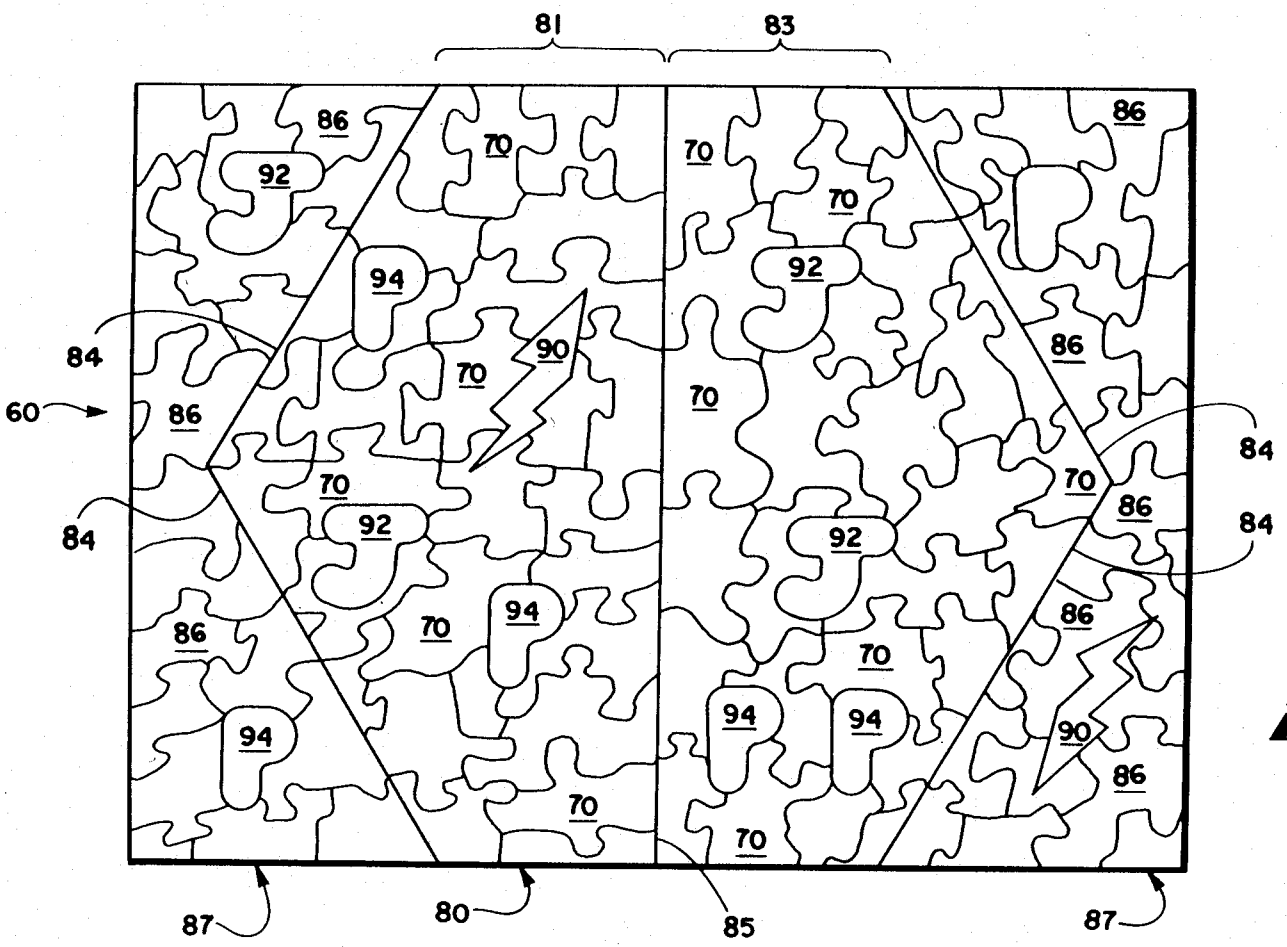
FIG. 7 shows a top plan view of a second embodiment of the present invention.
Figure 8:
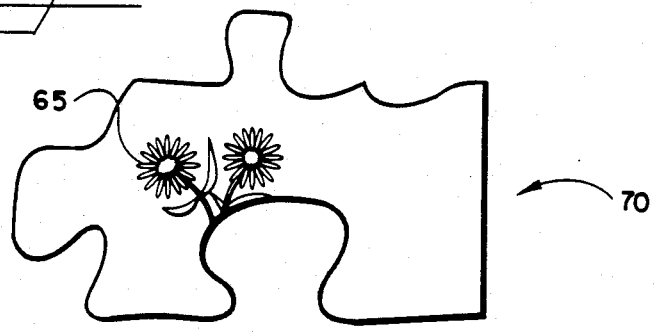
FIG. 8 shows a top plan view of a puzzle piece including indicia on its upper surface.

Referring now to FIG. 7, a second embodiment of the present invention is shown. The game of the second embodiment of the present invention is similar to the game of the first preferred embodiment but does not include game boards. When assembled, on a table or any other flat surface, a plurality of conventional interlocking jigsaw puzzle pieces form a rectangularly-shaped jigsaw puzzle 60. All of the jigsaw puzzle pieces contain indicia 65 on the upper surfaces, as shown in FIG. 8, so that, when the puzzle 60 is assembled, the indicia 72 collectively form a predetermined rectangular puzzle picture. Preferably, the rectangular puzzle 60 is formed from approximately one hundred and fifty interlocking puzzle pieces having a variety of shapes and indicia as described below.

Figure 9:
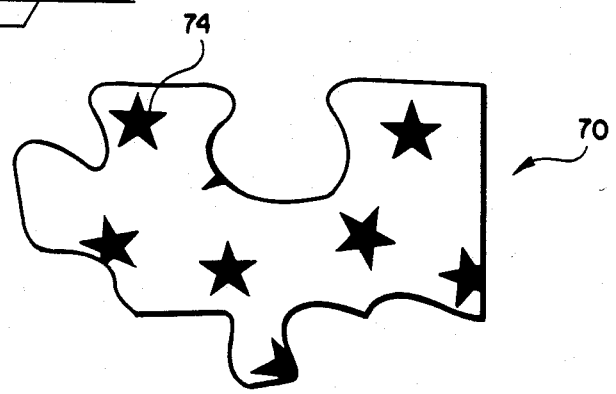
FIG. 9 shows a bottom plan view of the puzzle piece shown in FIG. 8.
Figure 10:
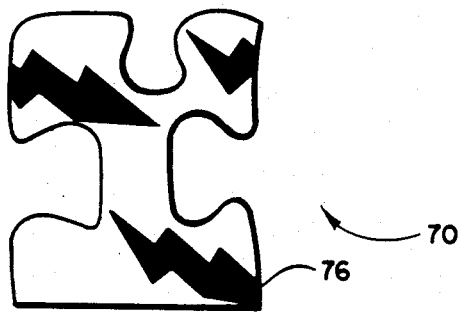
FIG. 10 shows a bottom plan view of a puzzle piece including alternative indicia on its lower surface.

A predetermined number of puzzle pieces 70 contain solid indicia 74 and 76 on their lower surfaces, as shown in FIGS. 9 and 10 so that, when these solid indicia-containing puzzle pieces 70 are assembled, a hexagonally-shaped puzzle 80 is formed. Preferably, the hexagonal puzzle 80 is formed from the assembly of approximately one hundred of the indicia-containing puzzle pieces 70. The hexagonal puzzle 80 is the same size and shape as the puzzle 18 of the first preferred embodiment which is assembled within a game board as described above with six equal sides 84. The hexagonal puzzle 80 can therefore be interchanged with the puzzle 18 of the first preferred embodiment if desired. A central dividing line 85 separates the hexagonal puzzle 80 into two equally sized inner puzzle regions so that a first player can assemble an inner puzzle region 81 on a first side of the central dividing line 85 while a second player simultaneously assembles a corresponding puzzle region 83 on the second side of the central dividing line 85. Ideally, the puzzle regions on either side of the dividing line will form a single jigsaw puzzle picture or two related pictures when both puzzle regions are assembled.

The solid indicia-containing puzzle pieces 70 to be assembled into inner puzzle region 81 on the first side of the central dividing line 85 will be marked on their lower surfaces with a first solid distinctive indicia 74 as shown in FIG. 9. The solid indicia-containing puzzle pieces 70 to be assembled into inner puzzle region 83 on the second side of the central dividing line 85 will be marked on their lower surfaces with an alternative second solid distinctive indicia 76 as shown in FIG. 10.

The remaining puzzle pieces 86, not including solid indicia 74 and 76 on their lower surfaces, may be assembled to form a pair of border areas 87 adjacent to the hexagonal puzzle 80 to form the rectangular jigsaw puzzle 60 described above.

Indicia 77 and 79 are imprinted on the lower surfaces of puzzle pieces 86. These indicia 77 and 79 are similar in shape to the solid indicia 74 and 76 on the lower surfaces of puzzle pieces 70, but are distinctive in that the indicia 77 and 79 are outlined as shown in FIGS. 11 and 12.

Figure 11:
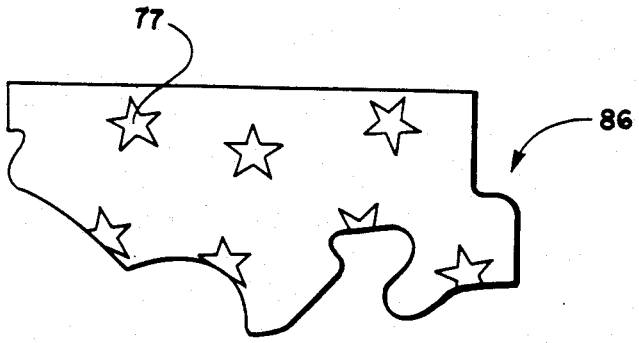
FIG. 11 shows a bottom plan view of a puzzle piece including outlined indicia on its lower side.
Figure 12:
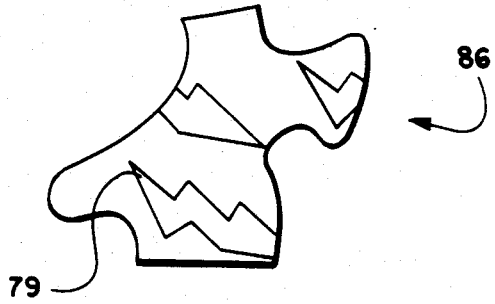
FIG. 12 shows a bottom plan view of a puzzle piece including outlined alternative indicia on its lower surface.

The puzzle pieces 86 which, when assembled, will form the border area 87 adjacent to the inner puzzle region 81 on the first side of the central dividing line 85, will be marked on their lower surfaces with a first outlined distinctive indicia 77 as shown in FIG. 11. The puzzle pieces 86, which will form the border area 87 adjacent to the inner puzzle region 83 on the second side of the central dividing line 85, will be marked on their lower surfaces with a second outlined distinctive indicia 79 as shown in FIG. 12.

When assembled, the puzzle pieces 70 and 86 bearing the first solid and outlined distinctive indicia 74 and 77 will form the puzzle contained on one side of the central dividing line 85. The puzzle pieces 70 and 86 bearing the second solid and outlined distinctive indicia 76 and 79 can then be assembled to form the puzzle contained on the opposite side of the central dividing line 85.

Thus, the first and second indicia all the two puzzles to be distinguished from one another before the pieces 70 and 86 are assembled into either the hexagonal puzzle 80 or the rectangular puzzle 60, and the two sides of the puzzle can be treated as separate puzzles when the game is played by two persons in the manner described below.

The rectangular puzzle 60 comprises certain distinctly different puzzle pieces 90, 92 and 94 having unconventional shapes. The first distinctly different puzzle piece 90 is the same size and shape as the distinctly different piece 22 of the first embodiment. The second distinctly different puzzle piece 92 resembles the letter "J". The third distinctly different puzzle piece 94 resembles the letter "P". Each of the pieces 92 and 94 represent predetermined portions within zones of the puzzle 60 and are used for scoring purposes.

Each player placing one of the distinctly different puzzle pieces 90, 92 and 94 within either the hexagonal puzzle 80 or the outer regions 87 receives a score. The scoring system is preferably the same as the scoring system described above in the first embodiment, with the omission of scoring for which a game board is required. For example, the first player to play each of the distinctly different puzzle pieces 90, 92 and 94 or a predetermined puzzle portion receives the score card having the highest value. Score cards can be awarded for completing borders, or zones such as half of the hexagonal zone 80, as well as for connecting a distinctively shaped piece to an edge, in a manner analogous to the scoring system described in connection with the first embodiment.

The rectangular puzzle 60 is composite, comprising inner puzzle regions 81 and 83 having solid indicia-bearing playing pieces 70 and outer puzzle regions 87 made up of outlined indicia-bearing interlocking pieces 86. The outer regions 87 are in abutment with sides 84 of the hexagonal puzzle 80.

The indicia 72 on the upper surfaces of the puzzle pieces 70 and 86 will be imprinted in such a way that, when assembled, the puzzle pieces 70 making up the hexagonal puzzle 80 will form a self-contained predetermined puzzle picture; and, when the puzzle pieces 86 making up the border areas 87 are assembled, the indicia 72 on the puzzle pieces 86 will supplement the indicia 72 on the puzzle pieces 70 creating the rectangular puzzle picture described above.

As in the first preferred embodiment, the game of the second embodiment of the present invention can be played competitively by players having varying skill levels by adjusting the number of puzzle pieces that each player must interconnect. For example, two players having equal skill could respectively assemble the puzzle pieces 86 and 70 on each side of the central dividing line 85 to jointly form the entire rectangular puzzle 60. Alternatively, a first player could assemble the puzzle pieces 86 and 70 on one side of the central dividing line 85 while the second player assembles only the solid indicia-containing puzzle pieces 70 designed to fit into the hexagonal puzzle 80 on the opposing side of the central dividing line 85.

While this invention has been described with particular reference to preferred embodiments thereof, it will be understood that variations and modifications can be made without departing from the spirit and scope of the invention as defined in the appended claims.

I claim:

1. A game to be played by a number of players comprising:

a separate jigsaw puzzle for each player, each jigsaw puzzle having a number of interlocking pieces, and scoring means associated with each puzzle, said scoring means assigning a first score to the player to first complete predetermined portions of any one puzzle and a less favorable score greater than zero for subsequent completions of the same portion, said scoring means identifying the potential scores remaining for completing predetermined puzzle portions, whereby the extent to which a given player has completed his associate puzzle and the potential scores remaining for completing predetermined puzzle portions identified by said scoring means affect the play of others seeking to maximize their score.

2. A game comprising a rectangular jigsaw puzzle comprising:

interlocking pieces and means for dividing said puzzle into two halves, each puzzle half being subdivided to form outer and inner regions, said inner regions of said puzzle halves abutting and collectively forming a hexagonal central puzzle portion with two sides of said hexagonal central puzzle each forming part of a side of said rectangular puzzle, said outer regions being at least essentially of a common color and said hexagonal central puzzle portion essentially forming a separate puzzle;

said puzzle including means for identifying predetermined portions for which scores are assigned upon the completion thereof, and means for assigning scores upon completion of portions, each divided region of said puzzle including at least two predetermined portions for which scores are assigned, said inner regions relative to said outer regions being of substantially different degree of difficulty to complete whereby players of different abilities may each be assigned an appropriate region of said puzzle to complete so that such players of different abilities can play the game competitively.

3. A game as claimed in claim 2, wherein the number of interlocking pieces making up an inner region and the number of interlocking pieces making up an outer region are in a ratio of about 1 to 2 respectively.

4. A game as claimed in claim 2, wherein said predetermined portions are common to all regions and said scoring means assigns a favorable score for the first completion of a given predetermined portion and a less favorable score for the subsequent completion of the same portion.

5. A game as claimed in claim 4, wherein said scoring means includes a plurality of sets of score cards, each set being associated with a particular predetermined portion, said score cards of each set being of different values whereby the first completion of a particular portion is assigned a more favorable score relative to subsequent completions of the same portion.

6. A game as claimed in claim 5, wherein scores for each subsequent completion of a predetermined portion is less favorable than the prior completion.

7. A game as claimed in claim 2, wherein said hexagonal puzzle portion includes straight side edges, at least four of which are in abutment with sides of said outer regions.

8. A game comprising:

a first jigsaw puzzle comprised of interlocking pieces;

means for dividing said first puzzle into two halves, each first puzzle half being subdivided to form outer and inner regions, said inner regions of said first puzzle halves abutting and collectively forming a central puzzle, said inner regions of said first puzzle being of a substantially different degree of difficulty to assemble;

said first puzzle including means for identifying predetermined portions for which scores are assigned upon the completion thereof, and means for assigning scores upon the completion of said predetermined portions, whereby players of different abilities may each be assigned an appropriate region of said first puzzle to assemble so that said players can play the game competitively.

9. The game of claim 8, wherein the number of interlocking pieces making up said inner region and the number of interlocking pieces making up said outer region are in a ratio of approximately 1:2 respectively.

10. The game of claim 8, wherein said predetermined portions are common to all regions and said scoring means assigns a favorable score for the first completion of a predetermined portion and a less favorable score for subsequent completions of the same portion.

11. The game of claim 8, wherein said first puzzle and said central puzzle define a plurality of straight side edges, two of said edges of said central puzzle each forming part of a side of said first puzzle.

12. The game of claim 8, wherein said scoring means includes a plurality of sets of score cards, each set being associated with a particular predetermined portion, said score cards of each set being of different values, whereby the first completion of a particular portion is assigned a more favorable score relative to subsequent completions of the same portions.

13. The game of claim 8, wherein scores for each subsequent completion of a predetermined portion is less favorable than the prior completion.

14. A game as claimed in claim 1, wherein said scoring means includes a game board for each player having indicia thereon defining an outline and a plurality of corresponding zones within said outline, at least some of said zones either individually or collectively defining said predetermined portions, and each puzzle, when assembled, fitting on a game board and covering said indicia.

15. A game as claimed in claim 14, wherein all game boards are similar or identical.

16. A game as claimed in claim 14, wherein at least some of said puzzles are of a different degree of difficulty determined by the difficulty in assembling the pieces of the puzzle.

17. A game as claimed in claim 16, wherein said scoring means includes indicia similar to the indicia provided on said boards.

18. A game as claimed in claim 16, wherein the degree of difficulty is at least partially determined by the number of interlocking pieces making up each puzzle.

19. A game as claimed in claim 18, wherein a variety of puzzles of different degrees of difficulty are provided to allow appropriate puzzle selection for players of differing ability so that players of substantially different abilities can play the game competitively.

* * * * *